US011313390B2

(12) United States Patent
Kondo et al.

(10) Patent No.: US 11,313,390 B2
(45) Date of Patent: Apr. 26, 2022

(54) HYDRAULIC DRIVE SYSTEM

(71) Applicant: KAWASAKI JUKOGYO KABUSHIKI KAISHA, Kobe (JP)

(72) Inventors: Akihiro Kondo, Kobe (JP); Naoki Hata, Kobe (JP); Nobuyuki Kinoshita, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/296,105

(22) PCT Filed: Jan. 31, 2020

(86) PCT No.: PCT/JP2020/003660
§ 371 (c)(1),
(2) Date: May 21, 2021

(87) PCT Pub. No.: WO2020/162353
PCT Pub. Date: Aug. 13, 2020

(65) Prior Publication Data

US 2022/0010820 A1 Jan. 13, 2022

(30) Foreign Application Priority Data

Feb. 8, 2019 (JP) ..... JP2019-021572

(51) Int. Cl.
*F15B 15/00* (2006.01)
*F15B 19/00* (2006.01)

(52) U.S. Cl.
CPC ..... *F15B 19/005* (2013.01); *F15B 15/00* (2013.01)

(58) Field of Classification Search
CPC ..... F15B 15/00; F15B 21/082; F15B 20/004; F15B 19/005; F15B 2211/8757
See application file for complete search history.

(56) References Cited

U.S. PATENT DOCUMENTS 6,055,851 A * 5/2000 Tanaka ..... E02F 9/26 73/40
2019/0078594 A1* 3/2019 Saitoh ..... E02F 9/22

FOREIGN PATENT DOCUMENTS

JP 2017129067 A 7/2017

* cited by examiner

*Primary Examiner* — Michael Leslie
*Assistant Examiner* — Daniel S Collins
(74) *Attorney, Agent, or Firm* — Alleman Hall Creasman & Tuttle LLP

(57) ABSTRACT

A hydraulic drive system includes: a first hydraulic pump of the variable capacitance type; a first regulator including a first proportional valve; a second hydraulic pump that dispenses operating oil; a switch valve; a control device; and a malfunction detection device. The switch valve can switch to a third valve position in which the switch valve allows the operating oil dispensed from both the first hydraulic pump and the second hydraulic pump to be supplied to first and second traveling hydraulic motors and first and second hydraulic actuators. The control device controls the operation of the first proportional valve by outputting a first flow rate command signal to the first proportional valve, and when the malfunction detection device detects a malfunction of an electrical system related to the first proportional valve, the control device switches the switch valve to the third valve position.

5 Claims, 6 Drawing Sheets

(b) HORSEPOWER CHARACTERISTICS OF PUMP ON NORMALLY-OPERATING SIDE (a) HORSEPOWER CHARACTERISTICS OF PUMP ON MALFUNCTIONING SIDE (a) DEGREE OF OPENING BETWEEN LEFT-SIDE PUMP PASSAGE AND CORRESPONDING SUPPLY PASSAGE (b) DEGREE OF OPENING BETWEEN RIGHT-SIDE PUMP PASSAGE AND CORRESPONDING SUPPLY PASSAGE

HYDRAULIC DRIVE SYSTEM

TECHNICAL FIELD

The present invention relates to a hydraulic drive system that includes two hydraulic pumps and if the flow rate of output falls below an expected flow rate due to a malfunction of one of the hydraulic pumps, can achieve a fail-safe with an appropriate compensatory function.

BACKGROUND ART

Construction vehicles such as a hydraulic excavator include a hydraulic drive system, and the hydraulic drive system supplies operating oil to a hydraulic actuator to operate the hydraulic actuator. The hydraulic drive system including such a function includes a variable-capacitance hydraulic pump, a regulator, and a control device, and the regulator adjusts the dispense flow rate of the hydraulic pump in accordance with a flow rate command signal received from the control device. In other words, some hydraulic drive systems can electrically control the dispense flow rate of a hydraulic pump.

In the hydraulic drive system configured as just described, in the event of malfunctions such as wire breakage and short circuit of, for example, an electrical system that connects the control device and the regulator, the capability of controlling the dispense flow rate of the hydraulic pump is lost, making the dispense flow rate excessively low or high. This may lead to an insufficient flow rate of operating oil to be supplied to the hydraulic actuator at the time of moving the hydraulic actuator or cause an engine to stall or stop. In order to avoid such trouble, the hydraulic drive system includes a fail-safe function to be used in the event of malfunctions such as wire breakage and short circuit of the electrical system or the like; a hydraulic system with a fail-safe such as that disclosed in Patent Literature (PTL) 1, for example, is known as a hydraulic drive system including said function.

In the hydraulic system with a fail-safe disclosed in PTL 1, an electromagnetic proportional valve for operating a flow rate control piston is an electromagnetic inversely proportional valve, and if a wire in this electromagnetic proportional valve is broken, the flow rate control piston ends up receiving a secondary pressure of approximately the same level as a primary pressure. As a result, the tilt angle of the hydraulic pump increases, and the dispense flow rate thereof increases. In order to avoid such trouble, the hydraulic system with a fail-safe disclosed in PTL 1 has the following configuration. Specifically, in said hydraulic system with a fail-safe, said electromagnetic proportional valve is connected to a horsepower control piston as well, and therefore the horsepower control piston also receives the secondary pressure output from the electromagnetic proportional valve. When the horsepower control piston receives the secondary pressure, contrary to the flow rate control piston, the horsepower control piston operates in such a manner as to reduce the tilt angle of the hydraulic pump, in other words, reduce the dispense flow rate of the hydraulic pump. In the hydraulic system with a fail-safe, one of the flow rate control piston and the horsepower control piston that reduces the dispense flow rate moves a spool preferentially. Therefore, in the event of wire breakage, short circuit, or the like in the electromagnetic proportional valve, the tilt angle of the hydraulic pump can be reduced, in other words, the dispense flow rate can be reduced; thus, it is possible to achieve a fail-safe.

CITATION LIST

Patent Literature

PTL 1: Japanese Laid-Open Patent Application Publication No. 2017-129067

SUMMARY OF INVENTION

Technical Problem

In the hydraulic system with a fail-safe disclosed in PTL 1, the horsepower control piston and an oil path connecting the horsepower control piston and the electromagnetic proportional valve are primarily needed only to provide the aforementioned fail-safe. Therefore, forming those makes the regulator larger in size and heavier in weight than a standard regulator without those. This results in high manufacturing cost of the pump. Particularly, in construction equipment on which two or more pumps are mounted such as a hydraulic excavator, the increases in the size and weight of the regulator will have even more prominent effects.

Thus, an object of the present invention is to provide a hydraulic drive system capable of achieving the fail-safe in the event of malfunctions such as wire breakage and short circuit while suppressing an increase in the number of components.

Solution to Problem

A hydraulic drive system according to the present invention includes: a first hydraulic pump of a variable capacitance type that dispenses operating oil to supply the operating oil to a first hydraulic actuator; a first regulator including a first proportional valve that operates in accordance with a first flow rate command signal received, the first regulator changing a dispense flow rate of the first hydraulic pump in accordance with the first flow rate command signal received by the first proportional valve; a second hydraulic pump that dispenses the operating oil to supply the operating oil to a second traveling hydraulic motor; a switch valve capable of switching between a first valve position and a second valve position, the first valve position being a position at which the switch valve allows the operating oil dispensed from the first hydraulic pump to be supplied to a first traveling hydraulic motor and allows the operating oil dispensed from the second hydraulic pump to be supplied to a second hydraulic actuator, the second valve position being a position at which the switch valve allows the operating oil dispensed from the first hydraulic pump to be supplied to the second hydraulic actuator and allows the operating oil dispensed from the second hydraulic pump to be supplied to the first traveling hydraulic motor; a control device that controls an operation of the first proportional valve by outputting the first flow rate command signal to the first proportional valve and controls an operation of the switch valve by outputting a switch command signal to the switch valve; and a malfunction detection device that detects a malfunction of an electrical system related to the first proportional valve. The switch valve is capable of switching to a third valve position at which the switch valve allows the operating oil dispensed from both the first hydraulic pump and the second hydraulic pump to be supplied to the first traveling hydraulic motor, the second traveling hydraulic motor, the first hydraulic actuator, and the second hydraulic actuator. When the malfunction detection device detects the malfunction of the electrical system related to the first proportional valve, the control device switches the switch valve to the third valve position.

According to the present invention, when the malfunction detection device detects a malfunction of the electrical system for the first proportional valve, the operating oil in the first hydraulic pump and the operating oil in the second hydraulic pump can be merged and guided to each of the first traveling hydraulic motor, the second traveling hydraulic motor, the first hydraulic actuator, and the second hydraulic actuator. Therefore, when the electrical system for the first proportional valve malfunctions, it is possible to guide, to each of the first traveling hydraulic motor, the second traveling hydraulic motor, the first hydraulic actuator, and the second hydraulic actuator, a larger amount of the operating oil than in the case where the operating oil is guided from the first hydraulic pump alone. Consequently, even when the electrical system for the first proportional valve malfunctions, a drastic reduction in the operating speed of each of the first traveling hydraulic motor and the first hydraulic actuator can be minimized. Thus, with the hydraulic drive system, it is possible to achieve a fail-safe for when the electrical system for the first proportional valve malfunctions. Furthermore, by using the switch valve that is a straight travel valve, it is possible to suppress an increase in the number of components.

A hydraulic drive system according to the present invention includes: a first hydraulic pump of a variable capacitance type that dispenses operating oil to supply the operating oil to a first hydraulic actuator; a first regulator that includes a first proportional valve operating and changes a dispense flow rate of the first hydraulic pump in accordance with a first flow rate command signal received by the first proportional valve; a second hydraulic pump that dispenses the operating oil to supply the operating oil to a second traveling hydraulic motor; a switch valve capable of switching between a first valve position and a second valve position in accordance with a pilot pressure received, the first valve position being a position at which the switch valve allows the operating oil dispensed from the first hydraulic pump to be supplied to a first traveling hydraulic motor and allows the operating oil dispensed from the second hydraulic pump to be supplied to a second hydraulic actuator, the second valve position being a position at which the switch valve allows the operating oil dispensed from the first hydraulic pump to be supplied to the second hydraulic actuator and allows the operating oil dispensed from the second hydraulic pump to be supplied to the first traveling hydraulic motor; a switch-valve proportional valve that outputs, to the switch valve, the pilot pressure corresponding to a switch signal received; a control device that controls an operation of the first proportional valve by outputting the first flow rate command signal to the first proportional valve and controls an operation of the switch valve by causing the switch-valve proportional valve to output the pilot pressure to the switch valve; and a malfunction detection device that detects a malfunction of an electrical system related to the first proportional valve. The switch valve is capable of switching to a third valve position at which the switch valve allows the operating oil dispensed from both the first hydraulic pump and the second hydraulic pump to be supplied to the first traveling hydraulic motor, the second traveling hydraulic motor, the first hydraulic actuator, and the second hydraulic actuator. When the malfunction detection device detects the malfunction of the electrical system related to the first proportional valve, the control device switches the switch valve to the third valve position.

According to the above configuration, when the malfunction detection device detects a malfunction of the electrical system for the first proportional valve, the operating oil in the first hydraulic pump and the operating oil in the second hydraulic pump can be merged and guided to each of the first traveling hydraulic motor, the first hydraulic actuator, and the second hydraulic actuator. Therefore, when the electrical system for the first proportional valve malfunctions, it is possible to guide, to each of the first traveling hydraulic motor and the first hydraulic actuator, a larger amount of the operating oil than in the case where the operating oil is guided from the first hydraulic pump alone. Consequently, even when the electrical system for the first proportional valve malfunctions, a drastic reduction in the operating speed of each of the first traveling hydraulic motor and the first hydraulic actuator can be minimized. Thus, with the hydraulic drive system, it is possible to achieve a fail-safe for when the electrical system for the first proportional valve malfunctions. Furthermore, by using the switch valve that is a straight travel valve, it is possible to suppress an increase in the number of components.

In the above invention, a second regulator may be further included, the second hydraulic pump may be of a variable capacitance type, the second regulator may include a second proportional valve that operates in accordance with a second flow rate command signal received, and changes a dispense flow rate of the second hydraulic pump in accordance with the second flow rate command signal received by the second proportional valve, and when the malfunction detection device does not detect the malfunction of the electrical system related to the first proportional valve, the control device may perform first horsepower control in which the dispense flow rate of the second hydraulic pump is changed on the basis of a dispense pressure of the second hydraulic pump to keep absorbed horsepower of the second hydraulic pump from exceeding first preset horsepower that is predetermined, and when the malfunction detection device detects the malfunction of the electrical system related to the first proportional valve, the control device may perform first malfunction horsepower control in which the dispense flow rate of the second hydraulic pump is changed on the basis of the dispense pressure of the second hydraulic pump to keep the absorbed horsepower of the second hydraulic pump from exceeding first malfunction preset horsepower that is greater than the first preset horsepower.

According to the above configuration, when the electrical system for the first proportional valve malfunctions, the insufficiency of the flow rate of the operating oil to be supplied to each of the first traveling hydraulic motor and the first hydraulic actuator can be further reduced. Consequently, a drastic reduction in the operation of each of the first traveling hydraulic motor and the first hydraulic actuator can be further minimized. Furthermore, it is possible to minimize a drastic reduction in the operation of each of the first traveling hydraulic motor and the first hydraulic actuator while performing the horsepower control so as not to exceed the preset horsepower.

In the above invention, a second regulator may be further included, the second hydraulic pump may be of a variable capacitance type, the second regulator may include a second proportional valve that operates in accordance with a second flow rate command signal received, and changes a dispense flow rate of the second hydraulic pump in accordance with the second flow rate command signal received by the second proportional valve, and when the malfunction detection device does not detect a malfunction of an electrical system related to the second proportional valve, the control device may perform second horsepower control in which the dispense flow rate of the first hydraulic pump is changed on the basis of a dispense pressure of the first hydraulic pump to keep absorbed horsepower of the first hydraulic pump from exceeding second preset horsepower that is predetermined, and when the malfunction detection device detects the malfunction of the electrical system related to the second proportional valve, the control device may perform second malfunction horsepower control in which the dispense flow rate of the first hydraulic pump is changed on the basis of the dispense pressure of the first hydraulic pump to keep the absorbed horsepower of the first hydraulic pump from exceeding second malfunction preset horsepower that is greater than the second preset horsepower.

According to the above configuration, when the electrical system for the second proportional valve malfunctions, the insufficiency of the flow rate of the operating oil to be supplied to each of the second traveling hydraulic motor and the second hydraulic actuator can be further reduced. Consequently, a drastic reduction in the operation of each of the second traveling hydraulic motor and the second hydraulic actuator can be further minimized. Furthermore, it is possible to minimize a drastic reduction in the operation of each of the first traveling hydraulic motor, the second traveling hydraulic motor, the first hydraulic actuator, and the second hydraulic actuator while performing the horsepower control so as not to exceed the preset horsepower.

In the above invention, the third valve position may be an intermediate valve position to be used in switching between the first valve position and the second valve position.

According to the above configuration, since the third valve position is an existing valve position of an existing straight travel valve, the existing straight travel valve can be used. Therefore, it is possible to easily suppress the rise in the manufacturing cost of a hydraulic drive system including the above-described functions.

Advantageous Effects of Invention

With the present invention, it is possible to achieve a fail-safe in the event of malfunctions such as wire breakage and short circuit while suppressing an increase in the number of components.

The above object, other objects, features, and advantages of the present invention will be made clear by the following detailed explanation of preferred embodiments with reference to the attached drawings.

DESCRIPTION OF EMBODIMENTS

Hereinafter, a hydraulic drive system 1 according to an embodiment of the present invention will be described with reference to the drawings. Note that the concept of directions mentioned in the following description is used for the sake of explanation; the orientations, etc., of elements according to the present invention are not limited to these directions. The hydraulic drive system 1 described below is merely one embodiment of the present invention. Thus, the present invention is not limited to the embodiment and may be subject to addition, deletion, and alteration within the scope of the essence of the present invention.

Figure 1:
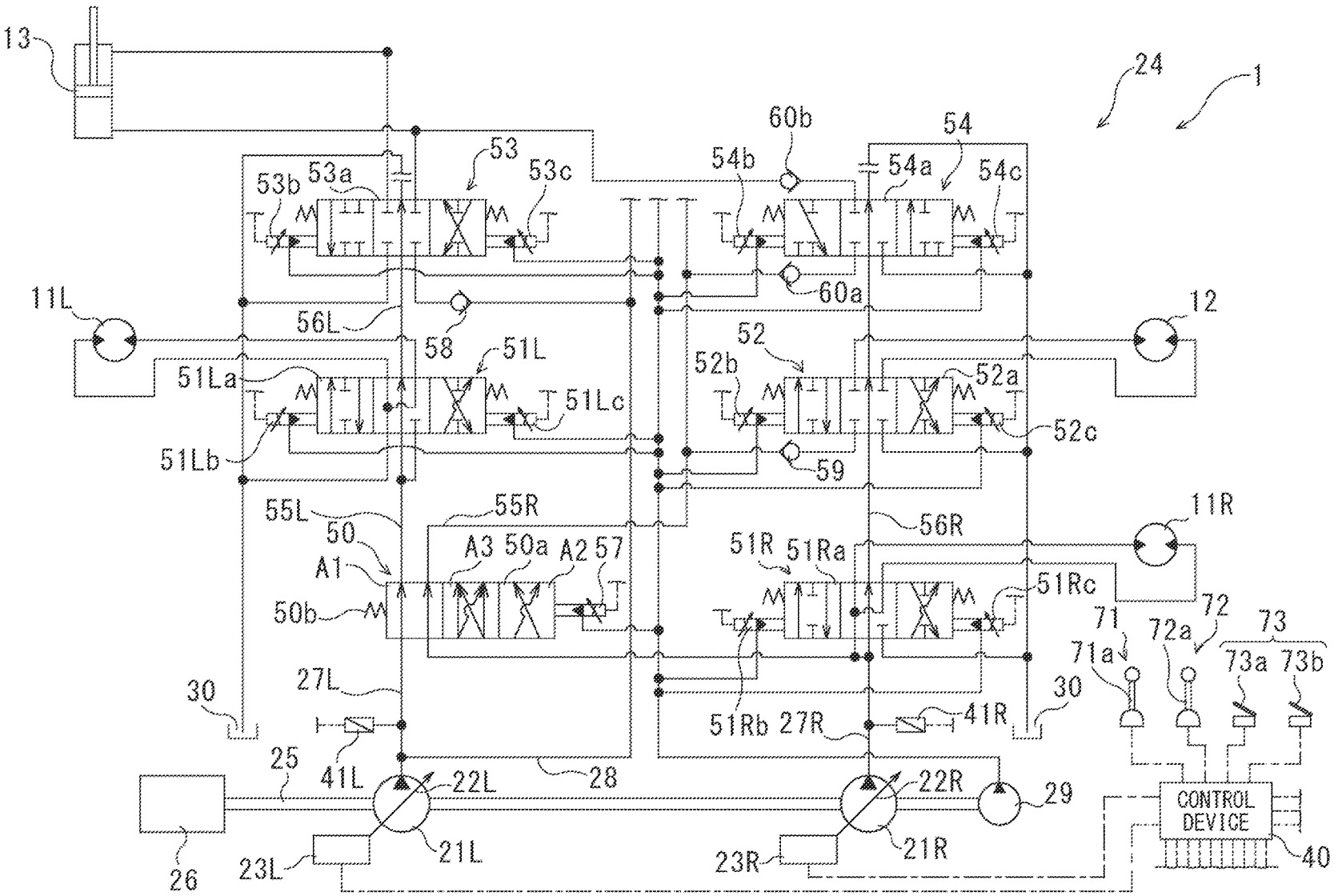
FIG. 1 is a circuit diagram illustrating a hydraulic circuit of a hydraulic drive system according to an embodiment of the present invention.

Construction equipment such a hydraulic excavator and a hydraulic crane includes various attachments such as a bucket and a hoist and is configured to move these attachments by hydraulic actuators such as a hydraulic cylinder and a hydraulic motor (electrohydraulic motor). Some construction equipment, namely, a construction vehicle, includes a traveling device such as a crawler and is configured to be able to travel using the traveling device. A hydraulic excavator, which is one example of the construction vehicle, includes one pair of left and right traveling hydraulic motors 11L, 11R such as those illustrated in FIG. 1 in order to drive the traveling device. The pair of left and right traveling hydraulic motors 11L, 11R is supplied with operating oil and can thereby move the hydraulic excavator forward and backward and change directions of the hydraulic excavator. Furthermore, a turning body is mounted on the traveling device, and a bucket is attached to the turning body via a boom and an arm. In the hydraulic excavator configured as just described, the turning body is configured to be able to turn with respect to the traveling device in order to change the orientations of the boom and the arm, and the hydraulic excavator includes a turning hydraulic motor 12 in order to turn the turning body. The turning hydraulic motor 12 is supplied with the operating oil and can thereby turn the turning body and change the orientations of the boom and the arm.

The boom is provided on the turning body so as to be able to swing vertically, and a boom cylinder 13 is provided on the boom in order to cause the boom to swing vertically, in other words, to raise and lower the boom. The boom cylinder 13, which is a hydraulic cylinder, is supplied with the operating oil and thereby extended and retracted to raise and lower the boom. The arm is attached to a tip end of the boom so as to be able to swing vertically, and the bucket is attached to a tip end of the arm so as to be able to swing vertically. The arm and the bucket can also swing using an arm cylinder and a bucket cylinder not illustrated in the drawings.

As described above, the hydraulic excavator can operate the actuators 11L, 11R, 12, 13 by supplying the operating oil thereto and thus can perform various tasks such as digging by operating the actuators 11L, 11R, 12, 13. The hydraulic excavator configured as described above includes the hydraulic drive system 1 in order to supply the operating oil to these actuators 11L, 11R, 12, 13.

<Hydraulic Drive System>

The hydraulic drive system 1 includes a fail-safe function related to the dispense flow rate of a pump and mainly includes two hydraulic pumps 21L, 21R, two regulators 23L, 23R, and a hydraulic supply device 24. The two hydraulic pumps 21L, 21R are, for example, tandem double pumps and can be driven by a shared input shaft 25. Note that the two hydraulic pumps 21L, 21R do not necessarily need to be the tandem double pumps and may be parallel double pumps or may each be a separately formed single pump. The number of hydraulic pumps included in the hydraulic drive system 1 is not necessarily limited to two and may be three or more. The two hydraulic pumps 21L, 21R configured as just described are connected to a drive source 26 such as an engine or an electric motor via the input shaft 25, and rotation of the input shaft 25 by the drive source 26 causes the operating oil to be dispensed from the two hydraulic pumps 21L, 21R. More specifically, pump passages 27L, 27R of the hydraulic supply device 24 to be described in detail later are connected to the two hydraulic pumps 21L, 21R, respectively, and the hydraulic pumps 21L, 21R dispense the operating oil to the pump passages 27L, 27R connected thereto.

The two hydraulic pumps 21L, 21R configured as described above are both variable-capacitance swash plate pumps and include swash plates 22L, 22R, respectively. Note that one of the two pumps that is close to the engine is denoted with the suffix L for the sake of explanation, but either side may be referred to as "L". Specifically, one of the two hydraulic pumps 21L, 21R, namely, the left hydraulic pump 21L, can change the dispense flow rate thereof by changing the tilt angle of the swash plate 22L, and the other of the two hydraulic pumps 21L, 21R, namely, the right hydraulic pump 21R, can change the dispense flow rate thereof by changing the tilt angle of the swash plate 22R. Furthermore, regulators 23L, 23R are provided on the hydraulic pumps 21L, 21R, respectively, in order to change the tilt angles of the swash plates 22L, 22R of the hydraulic pumps 21L, 21R. The following describes the configurations of the two regulators 23L, 23R; note that the two regulators 23L, 23R have the same configuration and fulfill the same function. Therefore, the configuration of one of the regulators, specifically, the left-side regulator 23L, will be primarily described while description of the configuration of the other of the regulators, specifically, the right-ide regulator 23R, will be omitted. Regarding reference signs given to the components of the regulators 23L, 23R, a component of the left-side regulator 23L is assigned a reference sign including "L", and a component of the right-side regulator 23R is assigned a reference sign including "R".

Figure 2:
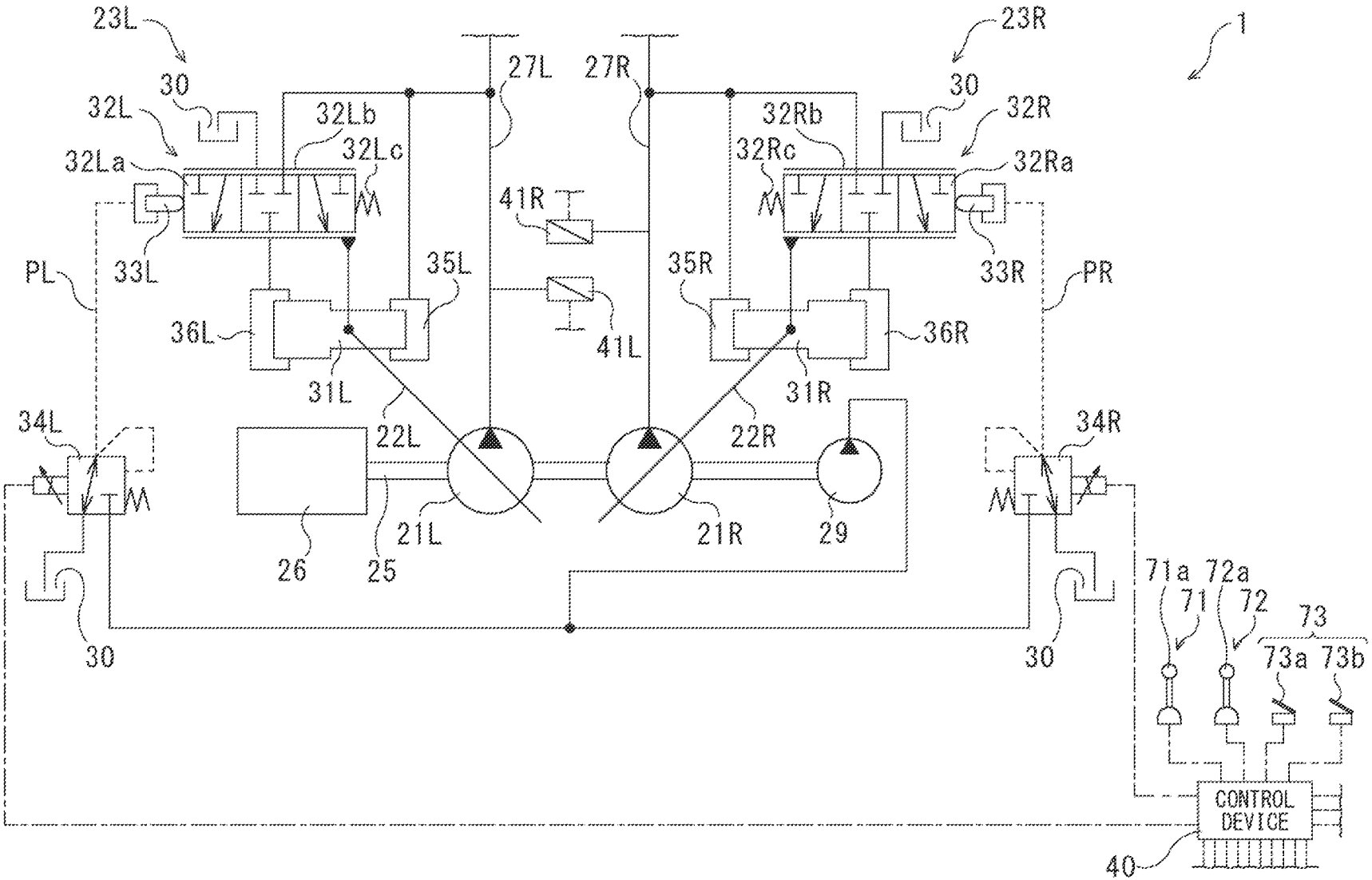
FIG. 2 is a circuit diagram illustrating a hydraulic circuit of a regulator included in the hydraulic drive system illustrated in FIG. 1.

The left-side regulator 23L includes a servo piston 31L, an adjustment valve 32L, a control piston 33L, and an electromagnetic proportional control valve 34L, as illustrated in FIG. 2. The servo piston 31L is configured to be movable along an axis thereof and operate in conjunction with the swash plate 22L of the left-side hydraulic pump 21L. Specifically, by moving the servo piston 31L to move the swash plate 22L, it is possible to change the tilt angle of the swash plate 22L. The servo piston 31L including such a function is formed with one end greater in diameter than the other end. Furthermore, in the left-side regulator 23L, two pressure-receiving chambers 35L, 36L are formed in order to provide a driving pressure (specifically, a dispense pressure and a control pressure to be described later) to each end of the servo piston 31L.

One of the pressure-receiving chambers, namely, a small-diameter chamber 35L, is connected to a dispensing passage for the left-side hydraulic pump 21L, and the dispense pressure of the left-side hydraulic pump 21L is introduced into the small-diameter chamber 35L. The other of the pressure-receiving chambers, namely, a large-diameter chamber 36L, is connected to the dispensing passage for the left-side hydraulic pump 21L via the adjustment valve 32L to be described in detail later, and a control pressure controlled by the adjustment valve 32L is introduced into the large-diameter chamber 36L. This means that the servo piston 31L changes a position thereof according to the introduced dispense pressure and the control pressure, and the tilt angle of the swash plate 22L is changed according to the position of the servo piston 31L. The adjustment valve 32L is connected to the other of the pressure-receiving chambers, that is, the large-diameter chamber 36L, in order to adjust the control pressure to be introduced into the large-diameter chamber 36L.

The adjustment valve 32L is connected to the left-side hydraulic pump 21L (more specifically, the left-side pump passage 27L connected to the left-side hydraulic pump 21L) and a tank 30 in addition to the other of the pressure-receiving chambers, that is, the large-diameter chamber 36L. The adjustment valve 32L includes a spool 32La and adjusts the control pressure by changing the position of the spool 32La and thereby controlling the degree of opening between the left-side pump passage 27L and the tank 30, each of which is connected to the other of the pressure-receiving chambers, that is, the large-diameter chamber 36L. Furthermore, the adjustment valve 32L includes a sleeve 32Lb.

The sleeve 32Lb is attached exteriorly to the spool 32La and is capable of relative movement with respect to the spool 32La. Furthermore, the sleeve 32Lb is configured to move in conjunction with movement of the servo piston 31L and adjusts the aforementioned degree of opening by changing the relative position with respect to the spool 32La. The control piston 33L and a spring member 32Lc are provided on the spool 32La of the adjustment valve 32L in order to adjust the position of the spool 32La.

In other words, the control piston 33L and the spring member 32Lc are disposed in order to apply opposing loads to the spool 32La. A signal pressure PL acts on an end of the control piston 33L, and the control piston 33L presses against the spool 32La with a pressing force corresponding to the signal pressure PL. A regulator electromagnetic proportional control valve 34L is connected to the control piston 33L configured as just described, in order to apply the signal pressure PL to the control piston 33L.

The regulator electromagnetic proportional control valve 34L is connected to a pilot pump 29 (for example, a gear pump), reduces the pressure of pilot oil dispensed from the pilot pump 29, and outputs the pilot oil to the control piston 33L. More specifically, the regulator electromagnetic proportional control valve 34L is an electromagnetic proportional control valves of the proportional type in which a secondary pressure increases with an increase in electric currents, and outputs the signal pressure PL having a value corresponding to the input flow rate command signal. The output signal pressure PL is provided to the control piston 33L as mentioned above, and the control piston 33L presses against the spool 32La with the pressing force corresponding to the signal pressure PL.

In the left-side regulator 23L configured as described above, the spool 32La moves to a position at which the pressing force of the control piston 33L and the biasing force of the spring member 32Lc are in balance, and the servo piston 31L slides to balance out axial forces generated by the hydraulic pressures in the large-diameter chamber 36L and the small-diameter chamber 35L and thus moves to a position corresponding to the spool 32La. This makes it possible to adjust the tilt angle of the swash plate 22L to an angle corresponding to the signal pressure PL applied to the control piston 33L. Therefore, the left-side regulator 23L can control the tilt angle of the swash plate 22L at an angle corresponding to the flow rate command signal input to the regulator electromagnetic proportional control valve 34L. In the left-side regulator 23L, a control device 40 is electrically connected to the regulator electromagnetic proportional control valve 34L in order to input the flow rate command signal to the regulator electromagnetic proportional control valve 34L.

The control device 40 outputs the flow rate command signal to each of the regulator electromagnetic proportional control valves 34L, 34R and controls the dispense flow rate of each of the hydraulic pumps 21L, 21R. Two pressure sensors 41L, 41R are electrically connected to the control device 40. Two pressure sensors 41L, 41R are provided corresponding to the two pump passages 27L, 27R and output, to the control device 40, signals corresponding to hydraulic pressures of corresponding pump passages 27L, 27R (in other words, the dispense pressures of the hydraulic pumps 21L, 21R). The control device 40 detects the dispense pressures of the hydraulic pumps 21L, 21R in accordance with the signals received from the pressure sensors 41L, 41R, outputs the flow rate command signals corresponding to the dispense pressures of the hydraulic pumps 21L, 21R, and controls the dispense flow rates of the hydraulic pumps 21L, 21R.

Figure 3:
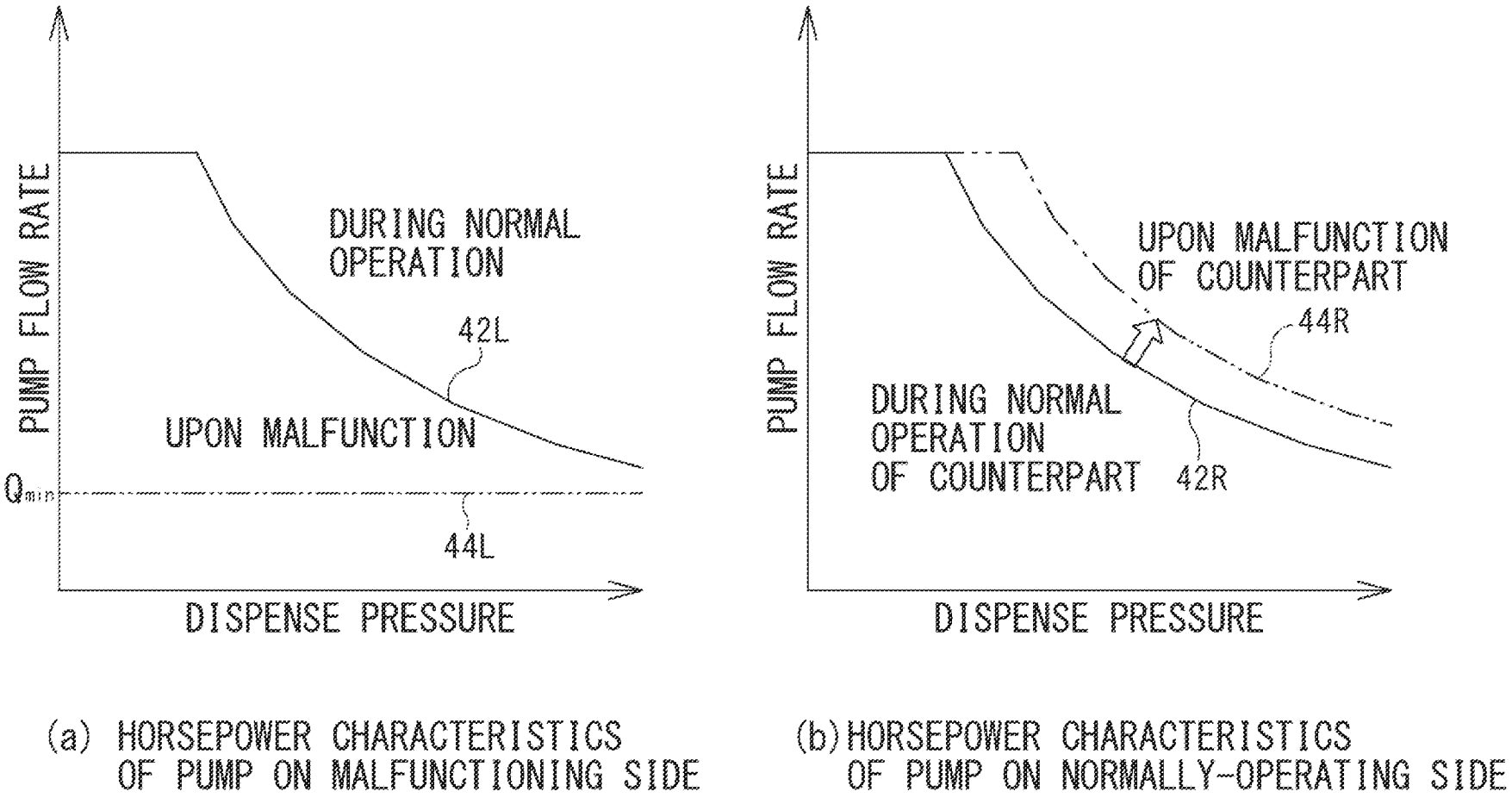
FIG. 3 is a graph illustrating horsepower characteristics of each pump in the hydraulic drive system illustrated in FIG. 1, with (a) illustrating horsepower characteristics of a pump on the malfunctioning side and (b) illustrating horsepower characteristics of a pump on the normally-operating side.

More specifically, the control device 40 stores horsepower characteristic lines 42L, 42R such as those illustrated in (a) and (b) in FIG. 3. The horsepower characteristic lines 42L, 42R indicate the relationship between the dispense pressure and the dispense flow rate of the hydraulic pumps 21L, 21R and are set on the basis of the maximum output or preset output (for example, preset output for improving fuel efficiency) of the drive source 26. Note that in the present embodiments, the horsepower characteristic lines 42L, 42R are set so that the sum of the horsepower of the two hydraulic pumps 21L, 21R, namely, total horsepower, does not exceed the maximum output of the drive source 26. The control device 40 calculates dispense flow rates on the basis of the horsepower characteristic lines and the detected dispense pressures and outputs, to the regulator electromagnetic proportional control valves 34L, 34R, the flow rate command signals corresponding to the calculated dispense flow rates. Thus, it is possible to control the dispense flow rates of the hydraulic pumps 21L, 21R so as not to exceed the first and second preset horsepower which are set on the basis of the maximum output or preset output (for example, preset output for improving fuel efficiency) of the drive source 26 (first and second horsepower control).

In this manner, the dispense flow rates of the hydraulic pumps 21L, 21R are controlled by the control device 40 and do not exceed the first and second preset horsepower. The hydraulic pumps 21L, 21R are connected to the hydraulic supply device 24 and operate the actuators 11L, 11R, 12, 13 by supplying the operating oil thereto via the hydraulic supply device 24. The configuration of the hydraulic supply device 24 will be described below.

The hydraulic supply device 24 includes a plurality of directional control valves 51L, 51R, 52-54 arranged corresponding to the aforementioned actuators 11L, 11R, 12, 13, in order to supply the operating oil to the actuators. More specifically, the hydraulic supply device 24 includes the left-side and right-side traveling directional control valves 51L, 51R arranged corresponding to the pair of left-side and right-side traveling hydraulic motors 11L, 11R, a turning directional control valve 52 arranged corresponding to the turning hydraulic motor 12, and first and second boom directional control valves 53, 54 arranged corresponding to the boom cylinder 13; among these, the first boom directional control valve 53 and the right-side traveling directional control valve 51R are connected to the hydraulic pumps 21L, 21R, respectively, without passing through a straight travel valve 50 to be described later. Note that in addition to the aforementioned actuators 11L, 11R, 12, 13, actuators such as the arm cylinder and the bucket cylinder are connected to the hydraulic supply device 24, but illustrations and description thereof are omitted in the present embodiment. The following first describes the first boom directional control valve 53 and the right-side traveling directional control valve 51R.

The first boom directional control valve 53 is connected to one of the hydraulic pumps, that is, the left-side hydraulic pump 21L, via the left-side pump passage 27. More specifically, a branch passage 28 branches from the left-side pump passage 27L, and the first boom directional control valve 53 is connected to the left-side pump passage 27L via the branch passage 28. Furthermore, a check valve 58 is provided between the first boom directional control valve 53 and the branch passage 28, and the flow of the operating oil from the first boom directional control valve 53 to the branch passage 28 is blocked by the check valve 58. The first boom directional control valve 53 disposed as just described is connected to the tank 30 and the boom cylinder 13 in addition to the left-side pump passage 27L and can switch the connection states of the tank 30 and the boom cylinder 13.

More specifically, the first boom directional control valve 53 includes a spool 53*a*. The spool 53*a* receives pilot pressures output from two different electromagnetic proportional control valves 53*a*, 53*c* provided at both ends of the spool 53*a* and moves to a position corresponding to the difference between the two pilot pressures received. Thus, it is possible to switch the connection between the boom cylinder 13 and each of the left-side pump passage 27L and the tank 30; in other words, the flow of the operating oil to the boom cylinder 13 can be switched, allowing the boom cylinder 13 to be extended and retracted in cooperation with the second boom directional control valve 54 to be described in detail later.

Meanwhile, the right-side traveling directional control valve 51R is connected to the other of the hydraulic pumps, that is, the right-side hydraulic pump 21R, via the right-side pump passage 27R. Furthermore, the right-side traveling directional control valve 51R is connected to the tank 30 and the right-side traveling hydraulic motor 11R in addition to the right-side pump passage 27R and can switch the connection states of the tank 30 and the right-side traveling hydraulic motor 11R. More specifically, the right-side traveling directional control valve 51R include a spool 51Ra. The spool 51Ra receives pilot pressures output from two different electromagnetic proportional control valves 51Rb, 51Rc provided at both ends of the spool 51Ra and moves to a position corresponding to the difference between the two pilot pressures received. Thus, it is possible to switch the connection between the right-side traveling hydraulic motor 11R and each of the right-side pump passage 27R and the tank 30; in other words, the flow of the operating oil to the right-side traveling hydraulic motor 11R can be switched.

Accordingly, the direction of rotation of the right-side traveling hydraulic motor 11R can be changed.

The two directional control valves 53, 51R configured as described above are constantly connected to the hydraulic pumps 21L, 21R via the passages 28, 27R, and the operating oil dispensed from the hydraulic pumps 21L, 21R are guided to the corresponding directional control valves 53, 51R. Meanwhile, the other three directional control valves 51L, 52, 54 can be selectively connected to the hydraulic pump 21L or the hydraulic pump 21R depending on the operating status of the hydraulic excavator, and the hydraulic supply device 24 includes the straight travel valve 50 in order to switch between the hydraulic pumps 21L, 21R to be connected.

The straight travel valve 50 is used to reduce the unevenness in the flow rates of the operating oil flowing to the pair of left and right traveling hydraulic motors 11L, 11R at the time of performing a boom operation, an arm operation, a bucket operation, or a turning operation while mainly causing the hydraulic excavator to travel straight. In order to fulfill such a function, the straight travel valve 50 switches between the hydraulic pumps 21L, 21R to be connected to each of the three directional control valves 51L, 52, 54. The straight travel valve 50 will be described in further detail below.

The straight travel valve 50 is connected to the left-side pump passage 27L and also connected to the right-side pump passage 27R. Furthermore, left-side and right-side supply passages 55L, 55R are connected to the straight travel valve 50, the left-side traveling directional control valve 51L is connected to the left-side supply passage 55L, and the turning directional control valve 52 and the second boom directional control valve 54 are connected in parallel to the right-side supply passage 55R. The straight travel valve 50 disposed as just described switches the connection states of these four passages 27L, 27R, 55L, 55R and switches between the hydraulic pumps 21L, 21R to be connected to each of the three directional control valves 51L, 52, 54.

More specifically, the straight travel valve 50 includes a spool 50*a*, and the function of the straight travel valve 50 is switched according to movement of the spool 50*a*. Stated differently, the spool 50*a* can move from a first valve position A1 defined by a zero stroke to a second valve position A2 defined by a Smax stroke. When the spool 50*a* is in the first valve position A1, the left-side pump passage 27L is connected to the left-side supply passage 55L, and the right-side pump passage 27R is connected to the right-side supply passage 55R (first function). When the spool 50*a* is in the first valve position A1, the left-side pump passage 27L and the right-side supply passage 55R are disconnected, and the right-side pump passage 27R and the left-side supply passage 55L are disconnected. In contrast, when the spool 50*a* is in the second valve position A2, the left-side pump passage 27L is connected to the right-side supply passage 55R, and the right-side pump passage 27R is connected to the left-side supply passage 55L (second function). When the spool 50*a* is in the second valve position A2, the left-side pump passage 27L and the left-side supply passage 55L are disconnected, and the right-side pump passage 27R and the right-side supply passage 55R are disconnected. Moreover, in the straight travel valve 50, at the time of movement of the spool 50*a* between the first valve position A1 and the second valve position A2, the connection states of the four passages 27L, 27R, 55L, 55R change continuously as follows.

Figure 4:
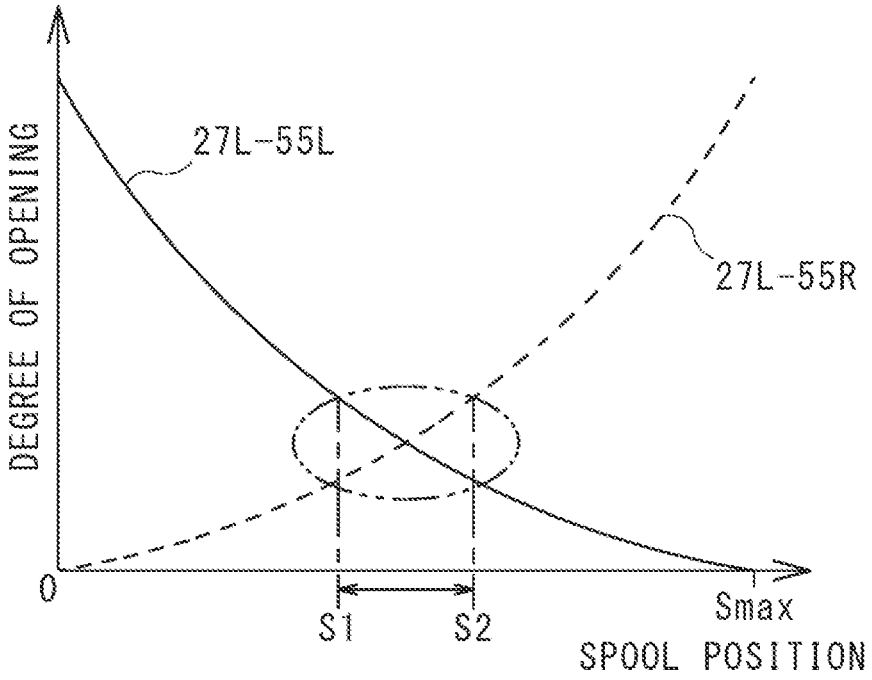
FIG. 4 is a graph illustrating a change in the degree of opening between each pump passage and a corresponding supply passage in the hydraulic drive system illustrated in FIG. 1, with (a) illustrating the degree of opening between a left-side pump passage and a corresponding supply passage and (b) illustrating the degree of opening between a right-side pump passage and a corresponding supply passage.
Figure 4:
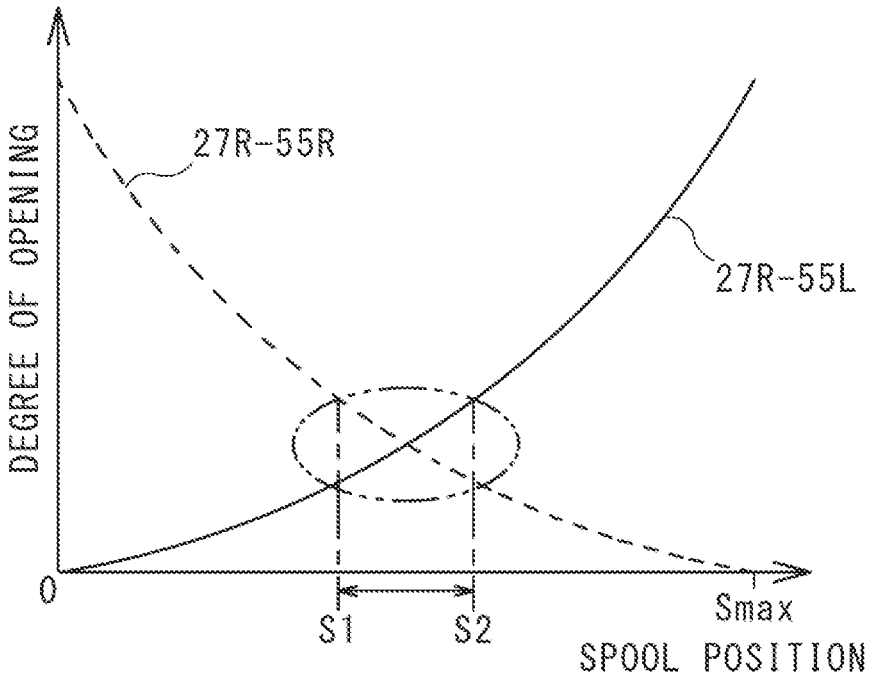

Specifically, the degree of opening between the left-side pump passage 27L and the left-side supply passage 55L is largest with the first valve position A1, as illustrated in (a) in FIG. 4, and is gradually reduced with an increase in the stroke of the spool 50*a* (refer to the solid line in (a) in FIG. 4). Reaching the second valve position A2 where the stroke is Smax results in disconnection of the left-side pump passage 27L and the left-side supply passage 55L. On the other hand, the left-side pump passage 27L and the right-side supply passage 55R, which are disconnected when the spool 50*a* is in the first valve position A1, start opening with movement of the spool 50*a* away from the first valve position A1, and as the stroke of the spool 50*a* increases, the degree of opening increases and becomes largest with the second valve position A2 (refer to the dashed line in (a) in FIG. 4). The degree of opening between the right-side pump passage 27R and the right-side supply passage 55R is largest with the first valve position A1, as illustrated in (b) in FIG. 4, and is gradually reduced with an increase in the stroke of the spool 50*a*. Reaching the second valve position A2 where the stroke is Smax results in disconnection of the right-side pump passage 27R and the right-side supply passage 55R (refer to the dashed line in (b) in FIG. 4). On the other hand, the right-side pump passage 27R and the left-side supply passage 55L, which are disconnected when the spool 50*a* is in the first valve position A1, start opening with movement of the spool 50*a* away from the first valve position A1, and as the stroke of the spool 50*a* increases, the degree of opening increases and becomes largest with the second valve position A2 (refer to the solid line in (b) in FIG. 4).

Thus, by moving the spool 50*a* to the first valve position A1 or the second valve position A2, the straight travel valve 50 can switch the passage to be connected to the left-side supply passage 55L or the right-side supply passage 55R between the pump passage 27L and the pump passage 27R. This means that the straight travel valve 50 can switch the hydraulic pumps 21L, 21R to be connected to the left-side and the right-side supply passages 55L, 55R. Furthermore, the degree of opening between the two pump passages 27L, 27R and the two supply passages 55L, 55R is continuously changed during the movement of the spool 50*a* between the first valve position A1 and the second valve position A2. The straight travel valve 50 including such a function includes a spring member 50*b* in order to change the position of the spool 50*a*.

The spring member 50*b* is provided at one end of the spool 50*a* and biases the spool 50*a* in order to place the spool 50*a* in the first valve position A1. Furthermore, a switch command pressure acts on the other end of the spool 50*a* to withstand the force of the spring member 50*b*, and a switch-valve electromagnetic proportional control valve (hereinafter referred to as a "switch-valve proportional valve") 57 is connected to the straight travel valve 50 in order to exert the switch command pressure. The switch-valve proportional valve 57 is electrically connected to the control device 40 and outputs the switch command pressure having a value corresponding to the switch command signal output from the control device 40. The output switch command pressure is provided to the other end of the spool 50*a* as mentioned above, and the spool 50*a* is pressed with the pressing force corresponding to the switch command pressure.

As described above, the basing force of the spring member 50*b* and the pressing force corresponding to the switch command pressure act on the ends of the spool 50*a* so as to oppose to each other, and the spool 50*a* moves to a position where these forces are in balance. In other words, when the switch command pressure which is output from the switch-valve proportional valve 57 is increased, the spool 50*a* moves toward the second valve position A2, and when the switch command pressure is reduced, the spool 50*a* moves toward the first valve position A1. Therefore, by adjusting the switch command pressure, it is possible to switch the connection destinations of the two pump passages 27L, 27R to one or both of the two supply passages 55L, 55R. The left-side traveling directional control valve 51L is connected to the left-side supply passage 55L, the connection destination of which is changeable as just described.

The left-side traveling directional control valve 51L is connected to the left-side traveling hydraulic motor 11L and the tank 30 in addition to the left-side supply passage 55L and can switch the connection states of the left-side traveling hydraulic motor 11L and the tank 30. More specifically, the left-side traveling directional control valve 51L includes a spool 51La. The spool 51La receives pilot pressures output from two different electromagnetic proportional control valves 51Lb, 51Lc provided at both ends of the spool 51La and moves to a position corresponding to the difference between the two pilot pressures received. Thus, the left-side traveling directional control valve 51L can switch the connection between the left-side traveling hydraulic motor 11L and each of the left-side supply passage 55L and the tank 30; in other words, the left-side traveling directional control valve 51L can switch the flow of the operating oil to the left-side traveling hydraulic motor 11L. Accordingly, the direction of rotation of the left-side traveling hydraulic motor 11L can be changed. The turning directional control valve 52 and the second boom directional control valve 54 are connected in parallel to the right-side supply passage 55R.

The turning directional control valve 52 is connected to the turning hydraulic motor 12 and the tank 30 in addition to the right-side supply passage 55R. Note that a check valve 59 is provided between the right-side supply passage 55R and the turning directional control valve 52, and the flow of the operating oil from the turning directional control valve 52 to the right-side supply passage 55R is blocked by the check valve 59. The turning directional control valve 52 disposed as just described can switch the connection states of the turning hydraulic motor 12 and each of the right-side supply passage 55R and the tank 30. More specifically, the turning directional control valve 52 includes a spool 52*a*. The spool 52*a* receives pilot pressures output from two different electromagnetic proportional control valves 52*b*, 52*c* provided at both ends of the spool 52*a* and moves to a position corresponding to the difference between the two pilot pressures received. Thus, the turning directional control valve 52 can switch the connection between the turning hydraulic motor 12 and each of the right-side supply passage 55R and the tank 30; in other words, the turning directional control valve 52 can switch the flow of the operating oil to the turning hydraulic motor 12. Accordingly, the direction of rotation of the turning hydraulic motor 12 can be changed.

The second boom directional control valve 54 is connected to the boom cylinder 13 and the tank 30 in addition to the right-side supply passage 55R. Note that a check valve 60*a* is provided between the right-side supply passage 55R and the second boom directional control valve 54, and the flow of the operating oil from the second boom directional control valve 54 to the right-side supply passage 55R is blocked by the check valve 60*a*. Furthermore, a check valve 60*b* is provided between the second boom directional control valve 54 and the boom cylinder 13, and the flow of the operating oil from the boom cylinder 13 to the second boom directional control valve 54 is blocked by the check valve 60*b*.

As with the first boom directional control valve 53, the second boom directional control valve 54 disposed as described above can switch the connection between the boom cylinder 13 and each of the right-side supply passage 55R and the tank 30. More specifically, the second boom directional control valve 54 includes a spool 54*a*. The spool 54*a* receives pilot pressures output from two different electromagnetic proportional control valves 54*b*, 54*c* provided at both ends of the spool 54*a* and moves to a position corresponding to the difference between the two pilot pressures received. Thus, it is possible to switch the connection between the boom cylinder 13 and each of the right-side supply passage 55R and the tank 30; in other words, the flow of the operating oil to the boom cylinder 13 can be switched, allowing the boom cylinder 13 to be extended and retracted in cooperation with the first boom directional control valve 53.

The hydraulic supply device 24 configured as described above further includes two bypass passages 56L, 56R; the directional control valves 51L, 53 are located in the bypass passage 56L, and the directional control valves 51R, 52, 54 are located in the bypass passage 56R. More specifically, one of the bypass passages, namely, the left-side bypass passage 56L, is formed as a branch of the left-side supply passage 55L. In this left-side bypass passage 56L, the left-side traveling directional control valve 51L and the first boom directional control valve 53 are arranged in the stated order from the upstream side. The left-side bypass passage 56L is connected to the tank 30 via a first bypass cut-off valve (not illustrated in the drawings) located on the downstream side of the two directional control valves 51L, 53 and allows discharge of the operating oil guided to the left-side supply passage 55L. Furthermore, the degree of opening of the left-side bypass passage 56L is adjusted according to the operation of the left-side traveling directional control valve 51L and the first boom directional control valve 53 located in the left-side bypass passage 56L. Specifically, for example, when the left-side traveling directional control valve 51L operates to rotate the left-side traveling hydraulic motor 11L or when the first boom directional control valve 53 operates to extend or retract the boom cylinder 13, the directional control valves 51L, 53 reduce the degree of opening of the left-side bypass passage 56L. This allows an increase in the pressure of the operating oil that is guided to the left-side supply passage 55L, and thus the left-side traveling hydraulic motor 11L and the boom cylinder 13 can be operated.

The other of the bypass passages, namely, the right-side bypass passage 56R, is formed as a branch of the right-side pump passage 27R. In this right-side bypass passage 56R, the right-side traveling directional control valve 51R, the turning directional control valve 52, and the second boom directional control valve 54 are arranged in the stated order from the upstream side. The right-side bypass passage 56R is connected to the tank 30 via a second bypass cut-off valve (not illustrated in the drawings) located on the downstream side of the three directional control valves 51R, 52, 54 and discharges the operating oil dispensed to the right-side pump passage 27R (that is, the operating oil dispensed from the right-side hydraulic pump 21R). Furthermore, each of the right-side traveling directional control valve 51R, the turning directional control valve 52, and the second boom directional control valve 54 adjusts, according to the operation thereof, the degree of opening of the right-side bypass passage 56R. Specifically, when the directional control valves 51R, 52, 54 operate to operate corresponding actuators, the operating directional control valves 51R, 52, 54 reduce the degree of opening of the right-side bypass passage 56R. This allows an increase in the pressure of the operating oil that flows in the right-side pump passage 27R. Thus, the actuators 11R, 12, 13 connected to the right-side hydraulic pump 21R can be operated.

In the hydraulic supply device 24 configured as described above, the operation thereof is controlled by the above-described control device 40, and a turning operation device 71, a boom operation device 72, and a traveling operation device 73 are electrically connected to the control device 40 in order to provide commands related to the operation of the hydraulic supply device 24. These three operation devices 71-73 are provided on the hydraulic excavator in order to operate the turning hydraulic motor 12, the boom cylinder 13, and the pair of traveling hydraulic motors 11L, 11R; for example, the operation devices 71-73 are electric joysticks or remote control valves. More specifically, the turning operation device 71 includes a turning operation lever 71*a* and is provided on the hydraulic excavator in order to operate the turning hydraulic motor 12. The turning operation lever 71*a* can be pulled down; when the operation lever 71*a* is pulled down, the turning operation device 71 outputs a signal to the control device 40.

The boom operation device 72 includes a boom operation lever 72*a* and is provided on the hydraulic excavator in order to operate the boom cylinder 13. The boom operation lever 72*a* can be pulled down; when the boom operation lever 72*a* is pulled down, the boom operation device 72 outputs a signal to the control device 40. The traveling operation device 73 includes one pair of left and right foot pedals 73*a*, 73*b* and is provided on the hydraulic excavator to operate the pair of left and right traveling hydraulic motors 11L, 11R; the foot pedal 73*a* is provided corresponding to the left-side traveling hydraulic motor 11L, and the foot pedal 73*b* is provided corresponding to the right-side traveling hydraulic motor 11R. Each of the foot pedals 73*a*, 73*b* can be operated, for example, by being stepped on with a foot; when the foot pedal 73*a*, 73*b* is operated, the traveling operation device 73 outputs a signal to the control device 40.

The control device 40 is designed to control the operation of the directional control valves 51L, 51R, 52-54 in accordance with the signals output from the three operation devices 71-73. The control device 40 is electrically connected the electromagnetic proportional control valves 51Lb, 51Lc, 51Rb, 51Rc, 52*b*-54*b*, 52*c*-54*c* provided on the directional control valves 51L, 51R, 52-54 and outputs command signals to the electromagnetic proportional control valves 51Lb, 51Lc, 51Rb, 51Rc, 52*b*-54*b*, 52*c*-54*c* in accordance with the signals output from the three operation devices 71-73. Furthermore, the control device 40 is electrically connected to the switch-valve proportional valve 57 provided on the straight travel valve 50 as well and outputs a switch command signal to the switch-valve proportional valve 57 in accordance with output signals of the three operation devices 71-73 (more specifically, an output signal of the traveling operation device 73).

The control device 40 configured as described above is further capable of detecting a malfunction of an electrical system for the regulator electromagnetic proportional control valves 34L, 34R, specifically, an electrical malfunction of the proportional valve 34L and an electrical malfunction of electrical wiring including connecting portions between the control device 40 and the proportional valve 34L (hereinafter referred to simply as a "malfunction). In other words, the control device 40 which is one example of the malfunction detection device outputs an electric current (malfunction detection signal) to each of the regulator electromagnetic proportional control valves 34L, 34R at a predetermined interval and detects the value of the electric current of the output malfunction detection signal. When the detected value of the electric current is less than or equal to a predetermined value, the regulator electromagnetic proportional control valve 34L, 34R is determined as electrically malfunctioning due to wire breakage or short circuit, in other words, a malfunction of the electrical system for the regulator electromagnetic proportional control valves 34L, 34R is detected.

<Operation of Hydraulic Drive System>

In the hydraulic drive system 1 configured as described above, the control device 40 controls the operation of the hydraulic supply device 24 in accordance with the operation performed on the three operation devices 71-73 and operates the actuators 11L, 11R, 12, 13. The operation of the control device 40 will be described below. When the turning operation lever 71*a* is solely operated and a signal is output from the turning operation device 71, the control device 40 outputs a turning command signal corresponding to said signal to the electromagnetic proportional control valve 52*b* (or the electromagnetic proportional control valve 52*c*) and operates the turning directional control valve 52. At this time, the spool 50*a* of the straight travel valve 50 is in the first valve position A1, and the turning directional control valve 52 is connected to the right-side hydraulic pump 21R via the right-side pump passage 27R and the right-side supply passage 55R. Therefore, the operating oil from the right-side hydraulic pump 21R is supplied to the turning hydraulic motor 12, and the turning hydraulic motor 12 rotates with the operating oil.

When the boom operation lever 72*a* is operated and a signal is output from the boom operation device 72, the control device 40 outputs a boom command signal corresponding to said signal to the electromagnetic proportional control valve 53*b* and the electromagnetic proportional control valve 54*b* (to raise the boom) (or the electromagnetic proportional control valve 53*c* and the electromagnetic proportional control valve 54*c* (to lower the boom)) and operates the first and second boom directional control valves 53, 54. At this time, the spool 50*a* of the straight travel valve 50 is in the first valve position A1, and the second boom directional control valve 53 is connected to the right-side hydraulic pump 21R via the right-side pump passage 27R and the right-side supply passage 55R. Therefore, the operating oil from the first and second hydraulic pumps is guided to the two directional control valves 51L, 51R, and the flows of the operating oil merge on the downstream side of the directional control valves 51L, 51R and can thus be guided to the boom cylinder 13 at the time of raising the boom. Thus, the boom can be raised at high speed. Note that at the time of lowering the boom, the operating oil is supplied to the boom cylinder 13 via the first boom directional control valve 53 alone, and the operating oil discharged from the boom cylinder 13 is discharged to the tank 30 via the second boom directional control valve 54 alone; the flow rates of the operating oil that is supplied to and discharged from the boom cylinder 13 are controlled independently of each other.

Next, when only one of the pair of foot pedals 73*a*, 73*b*, for example, the left-side foot pedal 73*a*, is operated and a signal is output from the traveling operation device 73, the control device 40 outputs a travel command signal corresponding to said signal to the electromagnetic proportional control valve 51Lb (or the electromagnetic proportional control valve 51Lc) and operates the left-side traveling directional control valve 51L. When only one of the pair of foot pedals 73*a*, 73*b* is operated, the spool 50*a* of the straight travel valve 50 is in the first valve position A1, and the left-side traveling directional control valve 51L is connected to the left-side hydraulic pump 21L via the left-side pump passage 27L and the left-side supply passage 55L. Therefore, the operating oil from the left-side hydraulic pump 21L is supplied to the left-side traveling directional control valve 51L, and the left-side traveling hydraulic motor 11L operates with the operating oil. In contrast, when both the foot pedals 73*a*, 73*b* are operated such as the case of causing the hydraulic excavator to travel straight, the control device 40 operates as follows.

Specifically, when a signal is output from the traveling operation device 73 in the state where both the foot pedals 73*a*, 73*b* are operated, the control device 40 outputs a switch command signal to the switch-valve proportional valve 57 connected to the straight travel valve 50 and causes the spool 50*a* to move the second valve position A2. Accordingly, the left-side pump passage 27L is connected to the right-side supply passage 55R, and the right-side pump passage 27R is connected to the left-side supply passage 55L. Thus, both the left-side and right-side traveling directional control valves 51L, 51R are connected to the right-side hydraulic pump 21R, and the directional control valves 52-54 other than the left-side and right-side traveling directional control valves 51L, 51R are connected to the left-side hydraulic pump 21L.

In the case where the left-side and right-side traveling directional control valves 51L, 51R are connected to the separate hydraulic pumps 21L, 21R, when the traveling hydraulic motors 11L, 11R and the other actuators 12, 13 are operated, the operating oil is guided to the other actuators 12, 13, and thus the operating oil cannot be guided to the traveling hydraulic motors 11L, 11R at a desired flow rate. Therefore, when the two foot pedals 73*a*, 73*b* are both operated with the same amount of operation in order for straight travel, the flow rates of the operating oil that is supplied to the traveling hydraulic motors 11L, 11R become uneven, causing a reduction in the straight-travel capability of the hydraulic excavator. In contrast, in the case where both the left-side and right-side traveling directional control valves 51L, 51R are connected to the right-side hydraulic pump 21R, the operating oil from the right-side hydraulic pump 21R is approximately evenly distributed to the traveling hydraulic motors 11L, 11R regardless of whether or not the other actuators 12, 13 are operated. Thus, the unevenness in the flow rates of the operating oil that is supplied to the traveling hydraulic motors 11L, 11R can be reduced, and it is possible to improve the straight-travel capability of the hydraulic excavator at the time of traveling straight.

Note that since the directional control valves 52-54 other than the left-side and right-side traveling directional control valves 51L, 51R are connected to the left-side hydraulic pump 21L, when another operation device, for example, the boom operation lever 72*a*, is operated at the time of traveling straight, the operating oil from the left-side hydraulic pump 21L is supplied to the boom cylinder 13 via at least one of the first and second boom directional control valves 53, 54. Therefore, even during the operation of the two traveling hydraulic motors 11L, 11R, it is possible to operate the boom cylinder 13 at the same time without affecting the traveling hydraulic motors 11L, 11R as mentioned earlier.

Furthermore, the control device 40 controls the degrees of opening of the left-side and right-side traveling directional control valves 51L, 51R at the time of traveling in accordance with the amount of operation performed on the corresponding foot pedals 73*a*, 73*b* and causes the traveling hydraulic motors 11L, 11R to supply the operating oil at a higher flow rate with an increase in the amount of operation. Therefore, when the amount of operation is large, in other words, when the travel speed increases, the flow rate may eventually become insufficient in the case where only the operating oil from the right-side hydraulic pump 21R is used. In such a case, the operating oil can be supplemented from the right-side supply passage 55R to the right-side pump passage 27R via a supplement unit 61 to cover the insufficiency of the flow rate.

<Fail-Safe Function of Control Device>

In the hydraulic drive system 1, when the regulator electromagnetic proportional control valves 34L, 34R malfunction due to wire breakage or short circuit, the following situation occurs. For example, when the regulator electromagnetic proportional control valve 34L malfunctions and the electric current no longer flows, the secondary pressure output from the regulator electromagnetic proportional control valve 34L matches the tank pressure, and the tilt angle of the swash plate 22L is maintained at the minimum tilt angle. This means that the dispense flow rate of the left-side hydraulic pump 21L is maintained at the minimum flow rate Qmin regardless of the dispense pressure of the left-side hydraulic pump 21L (refer to the dash-dot-dot line in (a) in FIG. 3). Thus, at the time of operating the actuators 11L, 12, 13, the flow rate of the operating oil that is supplied to the actuators 11L, 11R, 12, 13 connected to the left-side hydraulic pump 21L becomes significantly insufficient. In order to avoid such a situation, the control device 40 achieves the following fail-safe.

Figure 5:
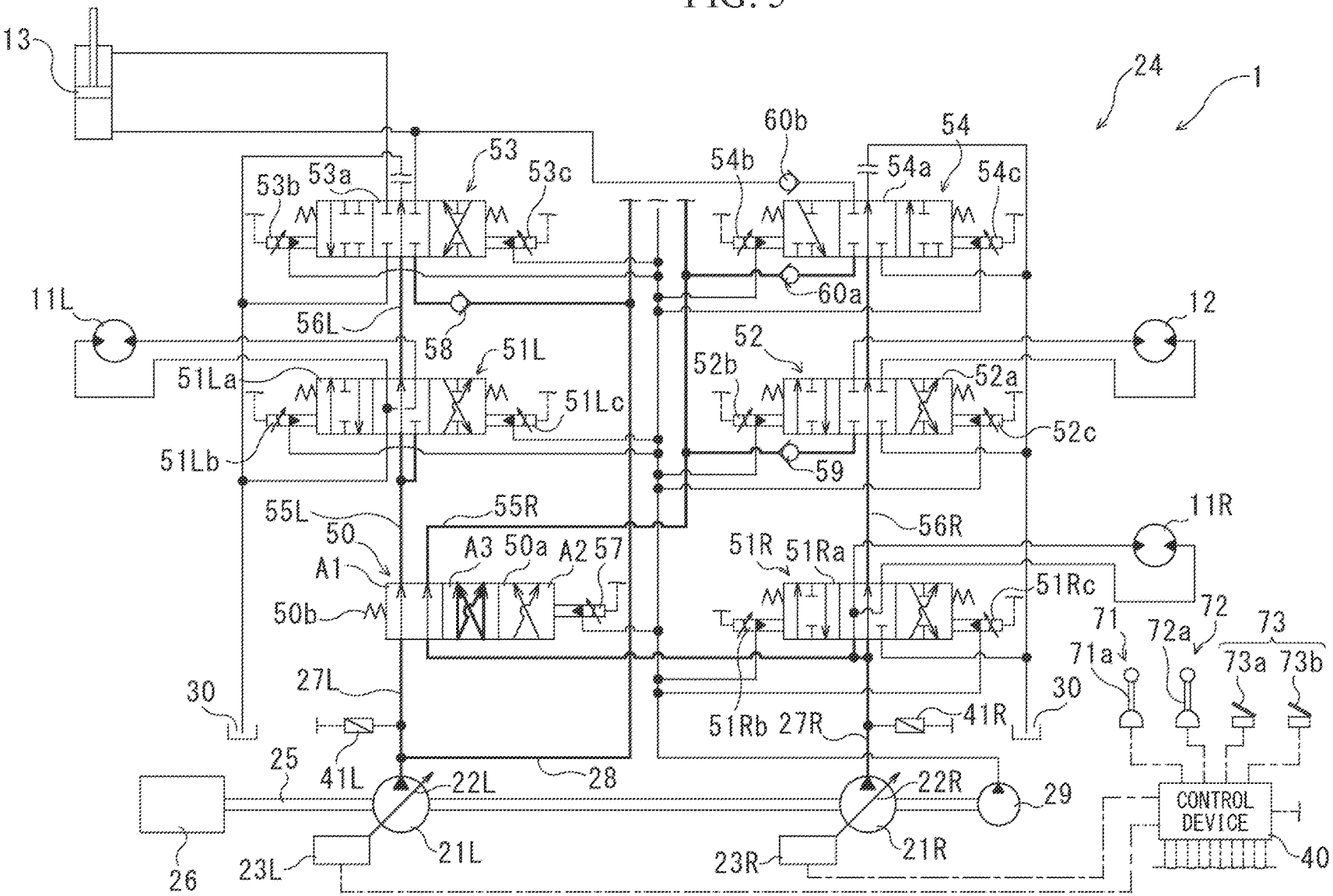
FIG. 5 is a circuit diagram illustrating the flow of operating oil at the time of a fail-safe in the hydraulic drive system illustrated in FIG. 1.

Specifically, when a malfunction of any of the two regulator electromagnetic proportional control valves 34L, 34R is detected, the control device 40 outputs a switch command signal to the switch-valve proportional valve 57. The switch command signal that is output at this time is a signal for causing the switch-valve proportional valve 57 to output a switch command pressure in order to position the spool 50*a* between the first valve position A1 and the second valve position A2. More specifically, the control device 40 outputs the switch command signal to the switch-valve proportional valve 57 in order to move the spool 50*a* to the third valve position A3 defined by the stroke S in the range of $S1 \leq S \leq S2$ (that is, the intermediate valve position between the first valve position A1 and the second valve position A2). When the spool 50*a* is in the third valve position A3, the degree of opening between the left-side pump passage 27L and one of the two supply passages 55L, 55R is substantially equal to the degree of opening between the left-side pump passage 27L and the other of the two supply passages 55L, 55R, and the degree of opening between the right-side pump passage 27R and one of the two supply passages 55L, 55R is also substantially equal to the degree of opening between the right-side pump passage 27R and the other of the two supply passages 55L, 55R. Placing the spool 50*a* in the third valve position A3 allows the operating oil from each of the two hydraulic pumps 21L, 21R to be distributed and flow to both the two supply passages 55L, 55R (refer to the thick line in FIG. 5). Therefore, it is possible to reduce the failure to operate the actuators 11L, 11R, 12, 13 due to the flow rate of the operating oil that is supplied to the actuators 11L, 11R, 12, 13 becoming significantly insufficient.

Furthermore, the control device 40 may operate as follows. Specifically, when a malfunction of any of the two regulator electromagnetic proportional control valves 34L, 34R is detected, for example, when a malfunction of the regulator electromagnetic proportional control valve 34L of the left-side regulator 23L is detected, the control device 40 switches the horsepower characteristic line of the right-side hydraulic pump 21R to the horsepower characteristic line 44R such as that indicated by the dash-dot-dot line in (b) in FIG. 3. In other words, the control device 40 sets the dispense flow rate of the right-side hydraulic pump 21R according to a horsepower characteristic line that is set on the basis of the first malfunction preset horsepower greater than the first preset horsepower after using the first preset horsepower. Furthermore, the control device 40 outputs a flow rate command signal to the regulator electromagnetic proportional control valve 34R of the right-side regulator 23R so as to achieve a dispense flow rate, and controls the operation of the right-side regulator 23R (first malfunction horsepower control). This allows the operating oil to be dispensed from the right-side hydraulic pump 21R at a higher dispense flow rate, with the dispense pressure unchanged, than in the case where the regulator electromagnetic proportional control valve 34 operates normally. Thus, it is possible to increase the flow rate of the operating oil that can be distributed to the actuators 11L, 11R, 12, 13, and therefore a drastic reduction in the operating speed of each of the actuators 11L, 11R, 12, 13 at the time of a fail-safe compared to that during normal operation can be minimized.

Note that the horsepower characteristic lines 42L, 42R which are set during normal operation are set to avoid, for example, stoppage of the drive source 26 (engine stall) attributable to insufficient output horsepower of the drive source 26 when the two hydraulic pumps 21L, 21R are driven at the same time. Thus, the state where the dispense flow rate of one of the two hydraulic pumps 21L, 21R is the minimum flow rate Qmin leads to significant extra output (namely, extra horsepower) relative to the maximum output of the drive source 26. Therefore, the drive source 26 does not stop even when the upper limit of the absorbed horsepower of the other of the hydraulic pumps 21R, 21L is changed from the first preset horsepower to the first malfunction preset horsepower. Consequently, the preset horsepower related to the right-side hydraulic pump 21R can be increased up to the first malfunction preset horsepower, and thus it is possible to minimize a drastic reduction in the operating speed of each of the actuators 11L, 11R, 12, 13 when the regulator electromagnetic proportional control valve 34L malfunctions.

Furthermore, although not described in detail, also when a malfunction of the regulator electromagnetic proportional control valve 34R of the right-side regulator 23R is detected, the control device 40 fulfills substantially the same function as that fulfilled in the case of a malfunction of the regulator electromagnetic proportional control valve 34L of the left-side regulator 23L. Specifically, when the malfunction is detected, the control device 40 outputs the switch command signal to the switch-valve proportional valve 57 in order to move the spool 50*a* to the third valve position A3 and switches the horsepower characteristic line of the left-side hydraulic pump 21L to the horsepower characteristic line such as that indicated by the dash-dot-dot line in (b) in FIG. 3. In other words, the control device 40 sets the dispense flow rate of the left-side hydraulic pump 21L according to a horsepower characteristic line that is set on the basis of the second malfunction preset horsepower greater than the second preset horsepower after using the second preset horsepower, and controls the operation of the left-side regulator 23L (second malfunction horsepower control) on the basis of the dispense flow rate. Thus, it is possible to minimize a drastic reduction in the operating speed of each of the actuators 11L, 11R, 12, 13 at the time of a fail-safe compared to that during normal operation.

The hydraulic drive system 1 configured as described above fulfills the fail-safe function using the third valve position A3 of the existing straight travel valve 50 in the hydraulic excavator. Therefore, there is no need to add a new element, and thus it is possible to keep down the manufacturing cost of the hydraulic drive system 1.

OTHER EMBODIMENTS

In the hydraulic drive system 1 according to the present embodiment, the straight travel valve 50 is described as an example of the switch valve, but the switch valve is not limited to the straight travel valve 50. In other words, it is sufficient that the switch valve have the following functions. Specifically, it is sufficient that the switch valve be connected to the two hydraulic pumps 21L, 21R and at least two directional control valves, be capable of switching the directional control valve to be connected to each of the hydraulic pumps 21L, 21R, and further be capable of connecting each of the two hydraulic pumps 21L, 21R to all the directional control valves in at least one connection state. In this case, a device on which the present invention is mounted is not limited to a construction vehicle and may be a construction machine, a robot, or the like that includes a hydraulic actuator.

Figure 6:
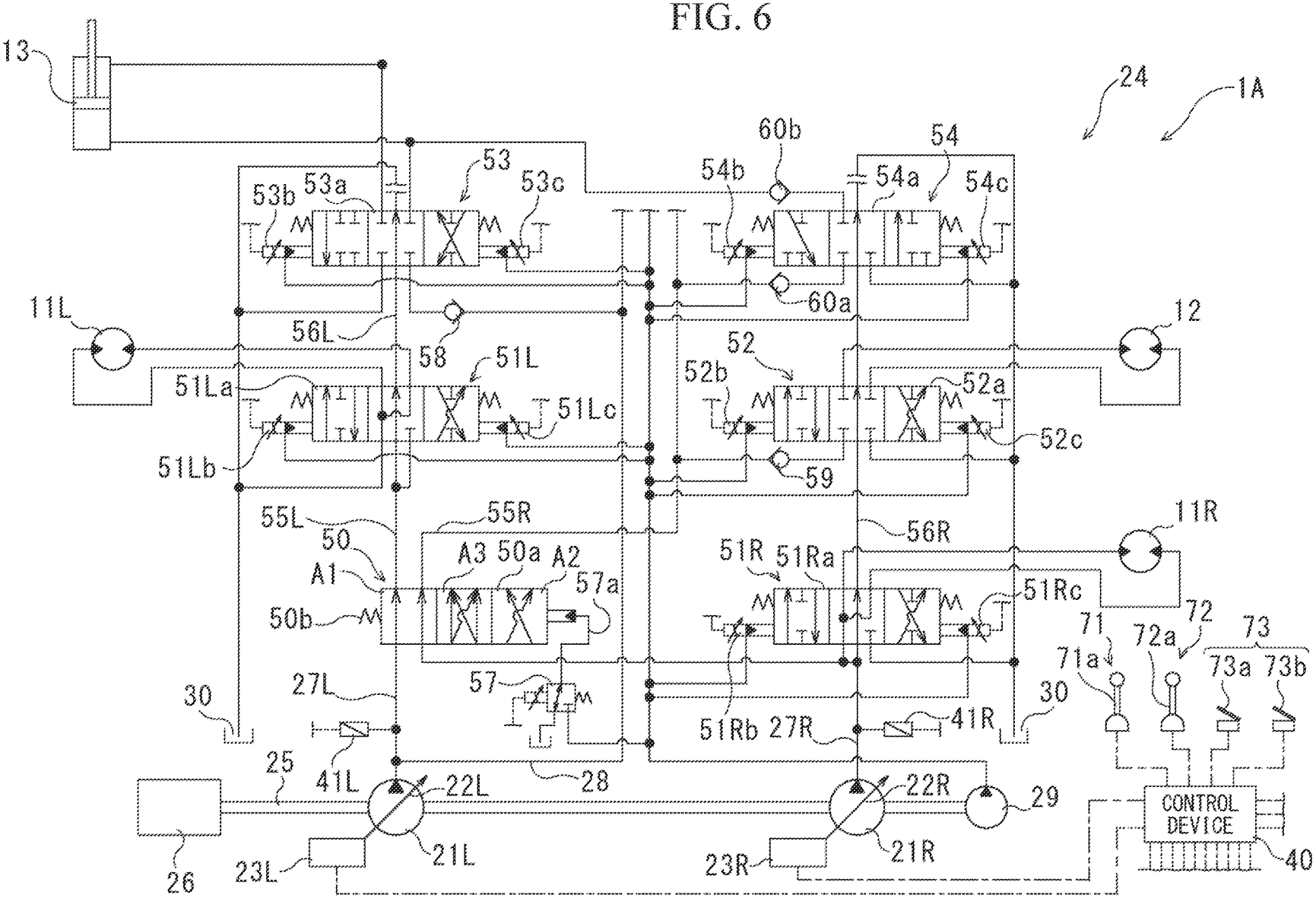
FIG. 6 is a circuit diagram illustrating a hydraulic circuit of a hydraulic drive system according to another embodiment of the present invention.

Furthermore, in the hydraulic drive system 1 according to the present embodiment, the two hydraulic pumps 21L, 21R do not necessarily need to be variable-capacitance swash plate pumps and may be variable-capacitance bent axis pumps. Moreover, in the hydraulic drive system 1 according to the present embodiment, the spool of each of the straight travel valve 50 and the directional control valves 51L, 51R, 52-54 is configured so as to operate according to the command pressure received from the corresponding electromagnetic proportional control valve, but the spool does not necessarily need to be formed as just described. Specifically, each of the straight travel valve 50 and the directional control valves 51L, 51R, 52-54 may have a spool that is directly driven by an actuator of the motor drive type or the electromagnetic drive type, and the configuration thereof is not limited. Furthermore, in FIG. 1, the straight travel valve 50 and the directional control valves 51L, 51R, 52-54 are illustrated as being formed integrally with the electromagnetic proportional control valves, but do not necessarily need to be integrated and may be formed as separate bodies. Specifically, as in a hydraulic drive system 1A according to another embodiment illustrated in FIG. 6, the straight travel valve 50 and the switch-valve proportional valve 57 may be formed as separate bodies. In this case, the switch command pressure (pilot pressure) that is output from the switch-valve proportional valve 57 is provided to the other end of the spool 50*a* through a pilot passage 57*a*. The hydraulic drive system 1A configured as just described produces substantially the same advantageous effects as the hydraulic drive system 1.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE CHARACTERS LIST

1 hydraulic drive system
11L left-side traveling hydraulic motor (first or second traveling hydraulic motor)
11R right-side traveling hydraulic motor (second or first traveling hydraulic motor)
12 turning hydraulic motor (second or first hydraulic actuator)
13 boom cylinder (first or second hydraulic actuator)
21L left-side hydraulic pump (first or second hydraulic pump)
21R right-side hydraulic pump (second or first hydraulic pump)
23L left-side regulator (first or second regulator)
23R right-side regulator (second or first regulator)
34L regulator electromagnetic proportional control valve (first or second proportional valve)
34R regulator electromagnetic proportional control valve (second or first proportional valve)
40 control device
50 straight travel valve (switch valve)
57 switch-valve electromagnetic proportional control valve (switch-valve proportional valve)

The invention claimed is:

1. A hydraulic drive system, comprising:

a first hydraulic pump of a variable capacitance type that dispenses operating oil to supply the operating oil to a first hydraulic actuator;

a first regulator including a first proportional valve that operates in accordance with a first flow rate command signal received, the first regulator changing a dispense flow rate of the first hydraulic pump in accordance with the first flow rate command signal received by the first proportional valve;

a second hydraulic pump that dispenses the operating oil to supply the operating oil to a second traveling hydraulic motor;

a switch valve capable of switching between a first valve position and a second valve position, the first valve position being a position at which the switch valve allows the operating oil dispensed from the first hydraulic pump to be supplied to a first traveling hydraulic motor and allows the operating oil dispensed from the second hydraulic pump to be supplied to a second hydraulic actuator, the second valve position being a position at which the switch valve allows the operating oil dispensed from the first hydraulic pump to be supplied to the second hydraulic actuator and allows the operating oil dispensed from the second hydraulic pump to be supplied to the first traveling hydraulic motor;

a control device that controls an operation of the first proportional valve by outputting the first flow rate command signal to the first proportional valve and controls an operation of the switch valve by outputting a switch command signal to the switch valve; and a malfunction detection device that detects a malfunction of an electrical system related to the first proportional valve, wherein:

the switch valve is capable of switching to a third valve position at which the switch valve allows the operating oil dispensed from both the first hydraulic pump and the second hydraulic pump to be supplied to the first traveling hydraulic motor, the second traveling hydraulic motor, the first hydraulic actuator, and the second hydraulic actuator; and when the malfunction detection device detects the malfunction of the electrical system related to the first proportional valve, the control device switches the switch valve to the third valve position.

2. A hydraulic drive system, comprising:

a first hydraulic pump of a variable capacitance type that dispenses operating oil to supply the operating oil to a first hydraulic actuator;

a first regulator that includes a first proportional valve and changes a dispense flow rate of the first hydraulic pump in accordance with a first flow rate command signal received by the first proportional valve;

a second hydraulic pump that dispenses the operating oil to supply the operating oil to a second traveling hydraulic motor;

a switch valve capable of switching between a first valve position and a second valve position in accordance with a pilot pressure received, the first valve position being a position at which the switch valve allows the operating oil dispensed from the first hydraulic pump to be supplied to a first traveling hydraulic motor and allows the operating oil dispensed from the second hydraulic pump to be supplied to a second hydraulic actuator, the second valve position being a position at which the switch valve allows the operating oil dispensed from the first hydraulic pump to be supplied to the second hydraulic actuator and allows the operating oil dispensed from the second hydraulic pump to be supplied to the first traveling hydraulic motor;

a switch-valve proportional valve that outputs, to the switch valve, the pilot pressure corresponding to a switch signal received;

a control device that controls an operation of the first proportional valve by outputting the first flow rate command signal to the first proportional valve and controls an operation of the switch valve by causing the switch-valve proportional valve to output the pilot pressure to the switch valve; and a malfunction detection device that detects a malfunction of an electrical system related to the first proportional valve, wherein:

the switch valve is capable of switching to a third valve position at which the switch valve allows the operating oil dispensed from both the first hydraulic pump and the second hydraulic pump to be supplied to the first traveling hydraulic motor, the second traveling hydraulic motor, the first hydraulic actuator, and the second hydraulic actuator; and when the malfunction detection device detects the malfunction of the electrical system related to the first proportional valve, the control device switches the switch valve to the third valve position.

3. The hydraulic drive system according to claim 1, further comprising:

a second regulator, wherein:

the second hydraulic pump is of a variable capacitance type;

the second regulator includes a second proportional valve that operates in accordance with a second flow rate command signal received, and changes a dispense flow rate of the second hydraulic pump in accordance with the second flow rate command signal received by the second proportional valve; and when the malfunction detection device does not detect the malfunction of the electrical system related to the first proportional valve, the control device performs first horsepower control in which the dispense flow rate of the second hydraulic pump is changed on the basis of a dispense pressure of the second hydraulic pump to keep absorbed horsepower of the second hydraulic pump from exceeding first preset horsepower that is predetermined, and when the malfunction detection device detects the malfunction of the electrical system related to the first proportional valve, the control device performs first malfunction horsepower control in which the dispense flow rate of the second hydraulic pump is changed on the basis of the dispense pressure of the second hydraulic pump to keep the absorbed horsepower of the second hydraulic pump from exceeding first malfunction preset horsepower that is greater than the first preset horsepower.

4. The hydraulic drive system according to claim 1, further comprising:

a second regulator, wherein:

the second hydraulic pump is of a variable capacitance type;

the second regulator includes a second proportional valve that operates in accordance with a second flow rate command signal received, and changes a dispense flow rate of the second hydraulic pump in accordance with the second flow rate command signal received by the second proportional valve; and when the malfunction detection device does not detect a malfunction of an electrical system related to the second proportional valve, the control device performs second horsepower control in which the dispense flow rate of the first hydraulic pump is changed on the basis of a dispense pressure of the first hydraulic pump to keep absorbed horsepower of the first hydraulic pump from exceeding second preset horsepower that is predetermined, and when the malfunction detection device detects the malfunction of the electrical system related to the second proportional valve, the control device performs second malfunction horsepower control in which the dispense flow rate of the first hydraulic pump is changed on the basis of the dispense pressure of the first hydraulic pump to keep the absorbed horsepower of the first hydraulic pump from exceeding second malfunction preset horsepower that is greater than the second preset horsepower.

5. The hydraulic drive system according to claim 1, wherein:

the third valve position is an intermediate valve position to be used in switching between the first valve position and the second valve position.

* * * * *